United States Patent [19]

Sabol

[11] 4,137,186

[45] Jan. 30, 1979

[54] PROCESS FOR THE MANUFACTURE OF OVERBASED MAGNESIUM SULFONATES

[75] Inventor: Albert R. Sabol, Munster, Ill.

[73] Assignee: Standard Oil Company (Indiana), Chicago, Ill.

[21] Appl. No.: 854,037

[22] Filed: Nov. 22, 1977

[51] Int. Cl.[2] ..... C10M 1/40; C10M 3/34; C10M 5/22; C10M 7/38

[52] U.S. Cl. ..... 252/33; 252/389 R

[58] Field of Search ..... 252/33, 389 R

[56] References Cited

U.S. PATENT DOCUMENTS 3,839,470 6/1958 Warren et al. ..... 252/33

3,865,737 2/1975 Kemp ..... 252/33

*Primary Examiner*—Irving Vaughn

*Attorney, Agent, or Firm*—Mark J. DiPietro; Arthur G. Gilkes; William T. McClain

[57] ABSTRACT

Process for preparing overbased magnesium sulfonate dispersions by hydrating at an elevated temperature a magnesium compound in the presence of an inert diluent, an alkanol, a sulfonic acid comprising a neutral ammonium sulfonate, and water, removing the alkanol and the displaced ammonia, and contacting the resulting mixture with an acidic material at a temperature of about 80° F to 155° F.

10 Claims, No Drawings

PROCESS FOR THE MANUFACTURE OF OVERBASED MAGNESIUM SULFONATES

This invention relates to a method of preparing overbased magnesium sulfonates. More particularly this invention relates to a process of producing overbased magnesium sulfonates wherein a magnesium compound is hydrated in the presence of an alkanol, an organic diluent, ammonia, a sulfonic acid compound; the alkanol and ammonia are stripped from the mixture and an acidic material is contacted with the mixture in the presence of water. More specifically, this invention relates to manufacture of highly overbased magnesium sulfonate with a TBN (Total Base Number) greater than 400 (metal ratio greater than 15) wherein the carbonation of the overbased magnesium sulfonate suspension is carried out in the substantial absence of alcohol and ammonia at a temperature between about 80° F. and 155° F.

Increasing the basicity of such detergent additive agents is commonly known as "overbasing". A highly desirable object of overbasing is to obtain the oil soluble carbonate, or sometimes other salt, of the alkaline earth metal in the form of extremely small particles in a finely dispersed form. Overbasing magnesium is especially difficult. It is particularly desirable to provide overbasing processes capable of producing relatively low cost overbased magnesium detergents. However, it has been difficult to obtain magnesium detergents having sufficient magnesium present to provide adequate high-temperature anti-rust and detergency for modern engines. Great difficulty has been encountered in utilizing inorganic basic magnesium compounds to an acceptable extent. Prior art attempts to utilize magnesium compounds often give discouraging results apparently due to some inability of the magnesium compounds and the sulfonic acid compounds to react sufficiently during neutralization and overbasing. In some cases, the dispersions are unstable, hazy, form gells, and/or do not yield reproducable high TBN, preferably above 400 (metal ratios about 15). Many commercially available sulfonic acids, such as sulfonic acids made from soft detergent alkylate bottoms, are resistant to overbasing. Other acids are not so resistant. However many sulfonic acids resistant to overbasing are of greatest commercial interest. These sulfonic acids resistant to overbasing are commonly used in mixtures with other sulfonic acids and the mixtures are also commonly resistant to overbasing.

Heavy-duty, detergent-type lubricating oil compositions suitable for use in diesel and other internal combustion engines, must satisfy at least two requirements (in addition to lubricity, stability and the like) if a high degree of engine cleanliness is to be maintained. First, the compositions must disperse insolubles formed by fuel combustion and/or oil oxidation. Secondly, the oil must neutralize both the acidic combustion products and acidic lacquer precursors providing rust inhibition.

Lubricating oil compositions used in marine diesel engines must have a high degree of reserve basicity, since marine engine fuels have a high sulfur content, which, in turn, results in a larger amount of acidic combustion products. Of course, it is possible to alleviate this problem through the use of lower sulfur fuels. However, the economics of the situation makes it desirable to use a high sulfur level in conjunction with a lubricating composition capable of neutralizing the acidic combustion products.

Numerous patents describe the preparation of overbased alkaline earth and specifically overbased magnesium sulfonates, such as Sabol et al. U.S. Pat. Nos. 3,524,814, 3,609,076, 3,126,340; Gergel et al., U.S. Pat. No. 3,629,109; Kemp et al., U.S. Pat. No. 3,865,737, etc. In general, these patents are capable of producing magnesium overbased sulfonates having a TBN of under 400 (metal ratio under 15) and/or inconsistent in the attainment of products having a TBN of at least 400 (metal ratio of 15) which are haze-free, gellation-free and not subject to appreciable thickening in the absence of methanol promoters. Gelled or thickened overbased magnesium sulfonates having a viscosity of greater than about 1100 SSU at 210° F. are unusable as lubricant additive anti-rust agents. Viscosities about 350–600 SSU at 210° F. are advantageous. Low viscosity additives blended with lubricant oil produce low viscosity highly desirable lubricants. Further, the prior art processes tend to be relatively complicated requiring organic amine, phenol, etc., promoters, and require careful monitoring of reaction conditions. For example, Gergel et al., U.S. Pat. No. 3,629,109 discloses the production of overbased magnesium sulfonates wherein water and alkanol are required as promoters during the addition of acidic material in a first stage, followed by removal of alcohol prior to a second stage addition of acidic material. Gergel et al. indicates that the alkanol can be omitted from the first stage addition of acidic material only if hazy low TBN (low metal ratios) products are acceptable. If metal ratios greater than 6 or a TBN greater than 140 are needed, Gergel requires in the carbonation step (column 10, line 39–71) the use of methanol and the use of other organic compounds as promoters, such as carboxylic acids, phenolics, tall oil, tall oil acids and succinic anhydride, etc. (see Examples 3, 4, 6, 7, 8, 9, 11, 12, 13, 14, 15, 16, 19, 20, 21, 22, 23 and 24). Otherwise Gergel et al. indicate that there are (column 9 lines 25–34 and column 10 line 72) gellation and thickening problems. Although Gergel et al. states that the carbonation temperature is not critical, the temperature taught in Gergel et al. for carbonation is the reflux temperature of the solution generally at least 75° C.–95° C. (167° F.–200° F.), Gergel Column 11, line 42–45. Accordingly, there is a need for a process of consistently producing haze-free gel-free overbased magnesium sulfonates having a high TBN, preferably at least 400 (metal ratio at least 15) in a single-stage methanol free addition of acidic material.

It appears that two chemical reactions occur in overbasing processes. Hydration of magnesium compounds and carbonation of the magnesium hydrate compound occur. During the hydration step the magnesium compound is converted to a hydrated magnesium hydroxide compound. This magnesium hydroxide compound during acidification, reacts with the acidic material and produces a complex salt of the magnesium salt of the acidic material and magnesium hydroxide compound. This complex salt reacts with water during carbanation and becomes hydrated. The reaction of the magnesium compound in the hydration and the reaction of the complex salt during the carbonation require the presence of water in both steps. Up to seven percent by weight of the final product is believed to be water of hydration formed during the hydration or carbonation step. The reactions seem to proceed as shown below:

Hydration: $MgA + 2H_2O = Mg(OH)_2 + HA$

Carbonation: $4Mg(OH)_2 + HB = 3MgB \cdot Mg(OH)_2 + 3H_2O$ $3MgB \cdot Mg(OH)_2 + XH_2O = 3MgB \cdot Mg(OH)_2 \cdot XH_2O$ A and B are common anions in this process such as oxide, chloride, nitrate, and sulfide. X is a number greater than about four. In much of the prior art, Gergel et al., Kemp et al., and Sabol et al., the reactions are performed simultaneously. Promoters are used in the prior art to enhance the overbasing reactions. We have discovered that although alkanols promote the hydration, they inhibit the carbonation. In other words, efficient adsorption of carbon dioxide by the magnesium hydrate compound is inhibited by the presence of alkanols.

The general object of this invention is to provide a new process of producing highly basic gell-free overbased sulfonates by single stage low temperature addition of acidic material, preferably carbon dioxide. Other objects appear hereinafter.

For the purpose of this invention, the amount of overbasing produced is reported as the Total Base Number (TBN) which is the number of milligrams of KOH equivalent to the amount of acid required to neutralize the alkaline constituents present in 1 gram of the composition. A standard procedure for measuring Total Base Number is ASTM D-2896. The metal ratio is the ratio of molar equivalents of an alkaline earth, for example magnesium, to molar equivalents of organic acid in the composition.

The objects of this invention can be attained by forming a composition comprising an oil-soluble organic sulfonic acid containing at least 0.1 percent by weight neutral ammonium sulfonate, a stoichiometric excess of basically reacting magnesium oxide based on the total equivalent of sulfonic acid compound, about 0.1–8 moles water per mole of magnesium compound, about 0.1–5 moles of alkanol per mole magnesium compound, and at least one substantially inert organic liquid diluent; hydrating the magnesium oxide at an elevated temperature (preferably at reflux), stripping the methanol from the reaction mixture and then adding an acidic material to the hydrated reaction mixture while maintaining the hydrated reaction mixture at a temperature of 80° F. to 155° F. Surprisingly, we have found that overbased magnesium sulfonates produced in this manner are gell-free and have reproducable TBN's of over 400 even using sulfonic acids formed from soft alkylate detergent bottoms. Although Gergel et al. suggests that the carbonation step can be carried out in the absence of methanol, relatively low TBN's and low metal ratios are obtained. Gergel et al. also indicates that the resultant products tend to be thickened and hazy. We believe that Gergel et al's. poor results are due to the presence of methanol and the temperatures disclosed by Gergel et al. for the acidification, e.g. carbonation step. At column 9, lines 59, Gergel et al. indicates that temperature of the carbonation step is not critical and should be carried out at reflux. However, our studies have shown that if the carbonation step is carried out at reflux, a crystalline form of overbased magnesium sulfonate is formed, instead of the amorphous type of overbased magnesium sulfonate which is necessary to obtain a haze-free product having a TBN over 400. These studies have also shown that amorphous products can only be produced if the carbonation step is at no more than 155° F. Above 155° F. crystallization of magnesium monohydrate salt tends to be induced. The higher the temperature above 155° F., the greater the crystallization. However, if methanol is present gellation occurs. Accordingly, the temperature range of 80° F. to 155° F. is critical in this invention.

Briefly, the process of this invention is carried out by forming a mixture of a magnesium compound, a hydrocarbon diluent, a lower alkanol, water and an oil soluble sulfonic acid compound comprising about 0.1 percent to 100 percent neutral ammonium sulfonate. This mixture is heated, preferably to reflux temperature, to hydrate the magnesium compound in an oil soluble sulfonic acid compound comprising about 0.1 percent 100 percent neutral ammonium sulfonate. This mixture is heated, preferably to reflux temperature, to hydrate the magnesium compound to the magnesium hydroxide hydrate. At the conclusion of the hydration the methanol and ammonia displaced from the ammonium sulfonate is stripped from the mixture. The mixture is then contacted with an acidic material, preferably $CO_2$, at a temperature between 80° F. and 155° F. until no more acidic material, carbon dioxide, is adsorbed and solids are then removed from the mixture.

Magnesium compounds useful in this invention include magnesium compounds which can be hydrated at the conditions present in the reaction, such as $MgCl_2$, $Mg(NO_3)_2$, MgO, etc. Preferably, highly active, light magnesium oxide is used since it reacts quickly and with great efficiency. Heavy "burned" magnesium oxide has the drawback that greater amounts of magnesium oxide and water are required to obtain similar results. From about 1 to 30 moles of magnesium compound can be used per mole of sulfonic acid compound.

The substantially inert diluent is ordinarily present in amounts between about 80 percent and 20 percent by weight of the reaction mixture during hydration. Suitable diluents include mineral oil, aliphatic, cyclo aliphatic, aromatic hydrocarbons, such as xylene, toluene, 5W lube oil and naphtha. Chlorinated hydrocarbons can also be used in this process. Preferably mixtures of mineral oil and xylene, toluene, or naphtha are used in the process. The boiling point of a xylene-mineral oil diluent is such that when the alkanol, such as methanol, present during hydration is stripped, the bulk of the xylene remains in solution. Xylene present in the diluent aids in process viscosity control.

The lower alkanol is used only in the hydration step. Although the use of alkanols is disclosed in many of the prior art patents, we have discovered that while alkanols promote hydration of magnesium compounds, alkanols inhibit carbonation of overbased magnesium sulfonate suspensions. Alkanols useful in the instant overbasing process include aliphatic alcohols containing one to seven carbon atoms such as methanol, ethanol, isopropanol, heptanol, etc. Methanol is preferred because of its low cost and high activity of methanol-magnesium compound reactions. Generally, from about 0.1 to 5 moles of alkanol per mole of magnesium compound can be used.

Water is required in the reaction mixture during the hydration and carbonation steps. Preferably water reacts with the magnesium salt to produce amorphous (non-crystalline) magnesium hydroxide suspensions. Generally about 1 to 8 moles of water per mole magnesium compound can be used.

The acidic materials which can be used in this invention include inorganic acids, usually acidic gases or liquids, such as $H_3BO_3$, $CO_2$, $H_2S$, $SO_2$, HCl, $NO_2$, $PCl_3$, $ClO_2$, $BF_3$, $CS_2$, COS, etc. Lower aliphatic carboxylic acids can also be used, e.g., oxalic, acetic, propionic acids, and the like. Formic acid is the preferred carboxylic acid. However, the inorganic acidic gases, particularly $CO_2$, $SO_2$ and $H_2S$ are generally used. Carbon dioxide is the preferred acidic material due to overall considerations of cost, ease of use, availability, and performance of the overbased magnesium sulfonate.

While any oil-soluble organic acids can be used, synthetic oil-soluble sulfonic acids are preferred. Suitable oil-soluble sulfonic acids can be represented by the general formulae:

$$R_x—Ar—(SO_3H)_y \quad \text{I}$$

$$R—(SO_3H)_y \quad \text{II}$$

In Formula I, Ar is a cyclic nucleus of the mono- or polynuclear type including benzenoid or heterocyclic neuclei such as a benzene, naphthalene, anthracene, 1,2,3,4-tetrahydrocaphthalene, thianthrene, or biphenyl-nucleus and the like. Ordinarily, however, Ar represents an aromatic hydrocarbon nucleus, especially a benzene or naphthalene nucleus. The R can be an aliphatic group such as alkyl, alkenyl, alkoxy, alkoxyalkyl, carboalkoxyalkyl, an aralkyl group, or other hydrocarbon or essentially hydrocarbon groups, while X is at least one with the proviso that the variables represented by the group $R_x$ are such that the acids are oil-soluble. This means that the groups represented by $R_x$ should contain at least about eight aliphatic carbon atoms per sulfonic acid molecule and preferably at least about twelve aliphatic carbon atoms. Generally X is an integer of 1-3. The variables r and y have an average value of one to about four per molecule.

The variable R′ in Formula II is an aliphatic or aliphatic-substituted cycloaliphatic hydrocarbon or essentially hydrocarbon radical. Where R′ is an aliphatic radical, it should contain at least about fifteen to about eighteen carbon atoms and where R′ is an aliphatic substituted-cycloaliphatic group, the aliphatic substituents should contain a total of at least about twelve carbon atoms. Examples of R′ are alkyl, alkenyl, and alkoxyalkyl radicals and aliphatic-substituted cycloaliphatic radicals wherein the aliphatic substituents are alkoxy, alkoxy-alkyl, carboalkoxyalkyl, etc. Generally the cycloaliphatic radical is a cycloalkane nucleus or a cycloalkene nucleus such as cyclopentane, cyclohexane, cyclohexene, cyclopentene, and the like. Specific examples of R′ are cetyl-cyclohexyl, laurylcyclohexyl, cetyl-oxyethyl and octadecenyl radicals, and radicals derived from petroleum, saturated and unsaturated paraffin wax, and polyolefins, including polymerized mono- and diolefins containing from about 1 to 8 carbon atoms per olefin monomer unit. The groups T, R, and R′ in Formulae I and II can also contain other substituents such as hydroxy, mercapto, halogen, amino, carboxy, lower carboalkoxy, etc., as long as the essentially hydrocarbon character of the groups is not destroyed.

Illustrative examples of the sulfonic acids are mahogany sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycaptyl benzene sulfonic acids, dicetyl thianthrene sulfonic acids, di-lauryl beta-naphthol sulfonic acids, dicapryl nitronaphthylene sulfonic acids, paraffin wax sulfonic acids, unsaturated paraffin wax sulfonic acids, hydroxy-substituted paraffin wax sulfonic acids, tetraisobutylene sulfonic acids, tetraamylene sulfonic acids, chloro-substituted paraffin wax, nitrocyl-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, and the like.

As used herein, the terminology "petroleum sulfonic acids" or "petrosulfonic acids" is intended to cover that well-known class of sulfonic acids derived from petroleum products according to conventional processes such as disclosed in U.S. Pat. Nos. 2,480,638; 2,483,800; 2,717,265; 2,726,261; 2,794,829; 2,832,801; 3,226,086; 3,337,613; 3,351,655; and the like, all of which are incorporated by reference. Sulfonic acids falling within Formula I and II are discussed in prior U.S. Pat. Nos. as 2,616,904; 2,616,905; 2,723,234; 2,723,235; 2,723,236; 2,777,874; and the other U.S. patents referred to in each of these patents, which are incorporated by reference.

Sulfonic acids derived from hard and soft detergent alkylate bottoms are advantageous in that these acids are commercially available. Both hard and soft acids are alkyl benzenes. Hard acids are alkyl benzenes in which the alkyl group is highly branched. The highly branched alkyl group provides greater oil solubility and little water solubility. The soft acids have a more straight chain less branched alkyl group. The different chain branching provides the soft acids greater water solubility and less oil solubility. This water solubility presents the greatest problem to overbasing techniques.

Of course, mixtures of the above-described organic acids and derivatives thereof susceptible to overbasing can be employed in the processes of this invention to prepare basic magnesium salts. In fact, as described below, some mixtures of acids can constitute preferred embodiments of the invention.

Neutral ammonium sulfonates can be obtained by blowing ammonia gas through the sulfonic acid, or by adding ammonium hydroxide to sulfonic acid. Water present in ammonium hydroxide can be removed. Sulfonic acid can be at room or elevated temperature or in a hydrocarbon solvent or neat during ammonia addition. Ammonium sulfonate during the hydration provides a source of ammonium ions. The magnesium compound during hydration displaces ammonia from the ammonium sulfonate compound. Once liberated the ammonia appears to promote hydration and suspension of magnesium by attacking basic atoms in the solid magnesium compound. This attack enhances the reactivity of the magnesium, and speeds hydration and suspension. As little as 0.1 percent by weight of the oil soluble sulfonic acid compound need be neutralized by ammonia. Only a small amount of ammonia is needed to promote the hydration and suspension of the magnesium compounds.

In somewhat greater detail the mixture of ammonium sulfonate, sulfonic acid compound, solvent, alkanol, magnesium compound and water are heated at an elevated temperature to hydrate the magnesium compound to produce magnesium hydroxide hydrate. During hydration the hydrated magnesium compound displaces and liberates ammonia from the sulfonate producing ammonia gas. The temperature of this hydration is not critical and is commonly done at reflux temperature. We have discovered that alkanol present in the reaction promotes hydration of the magnesium compounds, generally at a temperature of about 180° F.

At the end of the hydration step the alkanol, generally methanol, and the liberated ammonia must be removed. The methanol can be stripped by heating the hydrated mixture up to 280° F. Often methanol chemically bound to the hydrated magnesium compound must be displaced by water addition. Water displaces methanol from the hydrated magnesium compound by what appears to be a chemical reaction. Substantially complete removal of methanol is necessary. A stripping of methanol, water addition and a second stripping up to 280° F. may be required for total removal of methanol. During the stripping of methanol some xylene will be removed and two phases of solvent will form. The phases are a methanol/water phase and a xylene/water phase.

After the removal of methanol the mixture is treated with acidic material, preferably carbonated, at a temperature between 80° F. and 155° F. We have discovered methanol is an inhibitor to carbonation. Above 155° F. essentially crystalline mono-hydrated magnesium salts are formed. It is believed the crystalline nature of these salts cause precipitation, gellation, haziness, and low and unreproducable Total Base Numbers. Below 80° F. the carbonation reaction occurs at a sluggish rate. Between 80° F. and 155° F. an amorphous magnesium sulfonate is formed which does not gel, will not precipitate and will consistently give high TBN numbers. To insure complete carbonation of the mixture, the rate of carbon dioxide adsorption is measured. About 2 to 3 moles of water per mole of magnesium compound can be added during carbon dioxide addition. The water added during carbonation is added continuously during carbonation or in 2 to 4 increments at regular intervals during carbonation. Addition of all the water at the beginning of the carbonation step often produces a hazy product. The TBN and viscosity of the product however are not affected by haze produced by the early addition of water. Haze produced is merely a cosmetic defect. Substantially all acidic materials can be used in similar processes.

At the end of the carbonation, the solids are removed from the mixture by, for example, centrifugation. The remaining solvents are stripped by heating to about 340° F. to 350° F. while blowing with nitrogen.

EXAMPLE I

To a one-liter kettle reactor, equipped with an agitator, overhead condenser, heating mantle, gas sparger, and a temperature controller was charged. 160 gms of a 41.0 weight % polypropyl benzene sulfonic acid of soap equivalent weight of 563 the balance being unreacted polypropylene polymer and 5W oil. Ammonia gas was blown through the mixture at a rate of 0.88 moles per hour for one hour. 333 ml of xylene and 42.5 gms. of magnesium oxide were added and the mixture was heated to reflux. 25 ml of methanol and 44 ml. of water were added to the mixture while the mixture was maintained at reflux for 1 hour and 20 minutes. The mixture was then heated to 200° F. to strip methanol. Ten milliliters of water were added and the mixture was again stripped to 200° F. The mixture was cooled to 110° F. Carbon dioxide was passed through the mixture for 2.5 hours at 0.37 SCFH. 33 ml. of water were added during the first two hours of carbon dioxide addition. At the end of this period the solvents remaining in the mixture were stripped by heating to a temperature of about 350° F. The mixture was filtered. The clear and bright mixture was not excessively viscous and the TBN was 433.

EXAMPLE II

To a one-liter kettle reactor, equipped with an agitator, overhead condenser, heating mantle, gas sparger, and a temperature controller was charged. 154 g of 41.0 wt.% polypropyl benzene-sulfonic acid of soap equivalent weight 563 and the balance being unreacted polypropylene having a molecular weight about 400, and 5W oil diluent. With agitation, 10g of aqueous 28% $NH_4OH$ solution was added to neutralize the sulfonic acid. The mixture was heated to 300° F. with gentle nitrogen blowing. After cooling the mixture to below the temperature of xylene boiling point, 350 ml of xylene and 45g of magnesium oxide, MAGOX CUSTOM from Basic Chemicals Corp., and 25 ml of methanol were charged to the reactor. The reactor temperature was adjusted to reflux temperature, about 175° F., and 25 ml of water was added. The reactor temperature was gradually raised to 200° F., taking overhead condensates out of system. At 200° F., 20 ml of water was added and the reactor was held at reflux for 75 minutes. At this point, the originally charged MgO was substantially all converted to an amophous colloidally dispersed magnesium hydroxide in an alkylbenzene sulfonate suspension, 5W oil diluent, xylene, and some water, free of ammonia and methanol. The temperature of the reactor was adjusted to 120° F. Then, carbon dioxide was bubbled into the liquid mixture under good mixing. The $CO_2$ flow rate was maintained at 0.37 SCFH. After 45 minutes of carbonation with the temperature being maintained at 120° F.–125° F., 15 ml. of water was added to the reactor. The carbonation was continued for another 45 minutes under the same conditions as before. Then, 10 ml. of water was again added to the reactor and carbonation continued for an additional 45 minutes. At this point, the $CO_2$ uptake was less than 5%, and the reaction mixture was semi-transparent dark brown liquid. Upon centrifugation, 2.0% by volume of solids was removed from the clear centrate. The centrate was heated to 350° F. with gentle nitrogen blowing to remove the residual water and xylene solvent. The product thus obtained was clear and have the following properties:

Viscosity, SSU at 210° F. - 515
TBN - 435

EXAMPLE III

Example III was carried out with toluene as solvent in place of xylene under the same conditions as described in Example I. The product obtained had the following properties:

| | |
|---|---|
| Appearance | - Clear |
| Viscosity | - Not analyzed but low |
| TBN | - 424 |

Efficacy of the product obtained from the above process as a motor oil rust inhibitor and detergent component has been demonstrated by engine tests. The test results are given below:

Sequence IIC Rust Inhibition Test

| Formulation | Mg Sulfonate, Wt. % | Avg. Rust | Stock Lifters | Results |
|---|---|---|---|---|
| SAE 10W-30 | 0.90 | 8.6 | None | Pass |

| Caterpillar 1H2 Test | | | | | | | |
|---|---|---|---|---|---|---|---|
| Formulation | Mg Sulfonate, Wt. % | Hours | TGF | WCD | WLD | WTD | Result |
| SAE 30 | 1.3 | 480 | 26 | 86 | 29 | 115 | Pass |

EXAMPLE IV

To a one-liter kettle reactor equipped with an agitator, overhead condenser, heating mantel, gas sparger, and a temperature controller, was charged 0.16 moles of a polypropyl benzene sulfonic acid soap equivalent weight of 563 in a 41.3 percent by weight in SW oil. Aqueous ammonium hydroxide (0.16 moles) was added to neutralize the sulfonic acid. The mixture was heated to 300° F. with light nitrogen blowing. The mixture was cooled to below the reflux temperature of xylene. 371 grams of xylene, 71 grams of magnesium oxide and 15 ml of methanol were added to the mixture. The mixture was heated to reflux and 61 ml of water were added. The reaction was refluxed for 75 minutes. The mixture was heated to 200° F. and the overhead condensates were taken out of the system. At this point, substantially all methanol was removed.

The mixture was cooled to 120° F. Carbon dioxide at a rate of 0.37 SCFH was bubbled through the mixture. After 45 minutes, 15 ml of water was added to the mixture and the carbonation was continued for 45 minutes, an additional 10 milliliters of water were added to the mixture and carbonation was continued for an additional 45 minutes. The mixture was centrifuged to remove solids, and solvents were stripped by heating to 350° F. The product was a clear, low viscosity liquid.

EXAMPLE V

Example IV was repeated except the methanol stripping step was omitted. Upon addition of carbon dioxide, the product became very viscous. The thickening was caused by gell-like formation. Gelled high viscosity compositions are unusable as motor oil detergent and anti-rust agents.

EXAMPLE VI

Example II was repeated except a 50/50 mixture by weight of a polypropyl benzene sulfonic acid molecular weight about 450 and a Conoco sulfonic acid made from 60 weight percent of a polyethene benzene sulfonic acid molecular weight about 450 and 40 weight percent "detergent bottoms" made by alkylating benzene with a chlorinated "kerosene" and fractionating the alkylate keeping only the bottoms having a molecular weight about 450. The resulting composition was a clear composition of low viscosity having equivalent high TBN.

EXAMPLE VII

Example II was repeated except using an ESSO (France) sulfonic acid believed to be made from a benzene alkylate prepared by alkylating benzene with a dimerized dodecene, the alkylate molecular weight is about 400 to 500, and Steetly Refractions LYCAL Grade magnesium oxide. The resulting product gave equivalent clear, low viscosity, high TBN products.

EXAMPLE VIII

Example II was repeated using a HR-98 Basic Chemicals Company magnesium oxide. The resulting product had equivalent clarity, low viscosity and high TBN.

EXAMPLE IX

Example II was repeated using A-459 Merck Chemical Division magnesium oxide. The resulting product had equivalent clarity, low viscosity and high TBN.

EXAMPLE X

Example II was repeated using M-340 Velsicol Chemicals magnesium oxide. The resulting product had equivalent clarity, low viscosity and high TBN.

EXAMPLE XI

Example II was repeated using Martin Marietta 494 magnesium oxide. The resulting product had equivalent clarity, low viscosity and high TBN.

I claim:

1. A process for the manufacture of overbased magnesium sulfonate comprising forming a composition comprising an oil soluble sulfonic acid compound containing from about 1 to 100 weight percent oil soluble ammonium sulfonate, a stoichiometric excess based on the sulfonic acid compound of a hydratable magnesium compound, water, a lower alkanol and at least one substantially inert diluent, heating the composition to hydrate the magnesium compound, after the hydration is complete, heating the mixture to remove substantially all the lower alkanol, and then adding an acidic material to the mixture at a temperature between about 80° F. to 155° F. to form an amorphous magnesium suspension.

2. The process of claim 1 wherein the acidic material is carbon dioxide.

3. The process of claim 2 wherein the alkanol is methanol.

4. The process of claim 3 wherein the oil soluble sulfonic acid compound is an alkyl benzene sulfonic acid.

5. The process of claim 1 wherein the oil soluble sulfonic acid is an alkyl benzene sulfonic acid.

6. The process of claim 3 wherein from about 1 to 5 moles of methanol is present per mole of magnesium compound.

7. The process of claim 3 wherein the magnesium compound is magnesium oxide.

8. The process of claim 1 wherein the sulfonic acid is based on soft detergent alkylate bottoms.

9. The process of claim 1 wherein the hydratable magnesium compound is selected from a group consisting of $MgO$, $MgCl_2$, and $Mg(NO_3)_2$.

10. The process of claim 1 wherein the hydratable magnesium compound is a light magnesium oxide.

* * * * *